United States Patent [19]

Takeyama et al.

[11] 4,309,816

[45] Jan. 12, 1982

[54] METHOD OF MANUFACTURING GAS-CHARGED ELECTRIC SWITCHES

[75] Inventors: Hidetoshi Takeyama; Yukihiro Uezasa; Yasuo Yuasa, all of Kadoma, Japan

[73] Assignee: Matsushita Electric Works, Ltd., Osaka, Japan

[21] Appl. No.: 197,802

[22] PCT Filed: Feb. 26, 1979

[86] PCT No.: PCT/JP79/00045

§ 371 Date: May 12, 1980

§ 102(e) Date: May 12, 1980

[87] PCT Pub. No.: WO80/00637

PCT Pub. Date: Apr. 3, 1980

[30] Foreign Application Priority Data

Sep. 12, 1978 [JP] Japan ..... 53/112512

[51] Int. Cl.[3] ..... H01H 11/00

[52] U.S. Cl. ..... 29/622; 29/756; 200/302; 200/306

[58] Field of Search ..... 29/622, 756; 200/302, 200/306, 144 B, 144 AA; 53/88, 432

[56] References Cited

U.S. PATENT DOCUMENTS

| | | | |
|---|---|---|---|
| 2,951,321 | 9/1960 | Sennett | 29/622 UX |
| 3,182,382 | 5/1965 | Juptner | 29/622 |
| 3,360,382 | 12/1967 | Milter | 53/432 X |
| 3,897,672 | 8/1975 | Scheindel | 53/88 X |
| 4,004,337 | 1/1977 | Hill | 29/622 X |

FOREIGN PATENT DOCUMENTS

| | | |
|---|---|---|
| 39-6282 | 3/1964 | Japan . |
| 42-18367 | 9/1967 | Japan . |

*Primary Examiner*—Leon Gilden

*Attorney, Agent, or Firm*—Burns, Doane, Swecker & Mathis

[57] ABSTRACT

This method of manufacturing gas-charging electric switches comprises a step of housing an electric switch in a container provided with two gas substituting ports and closing an opening of the container for the housing to render the container hermetical except at the gas substituting ports, a step of pouring a gas through one of the gas substituting ports of the container and discharging a gas in the container through the other gas substituting port to perform the gas substitution in the container and a step of tightly sealing the gas substituting ports with punches when the concentration of the charged gas in the container reaches a required level, and these steps are incorporated in other steps as sequential steps in the general atmosphere.

1 Claim, 7 Drawing Figures

METHOD OF MANUFACTURING GAS-CHARGED ELECTRIC SWITCHES

TECHNICAL FIELD

This invention relates to a method of manufacturing gas-charged electric switches wherein an inert gas is poured, charged and sealed in a container for housing an electric switch to protect the switch from oxidation and deterioration due to an arc generation and, more particularly, to an improved method of manufacturing the gas-charged electric switches wherein steps of said pouring and charging of the gas and subsequent sealing of the container are simplified and these steps are made suitable for being performed in sequential steps in combination with other steps.

BACKGROUND ART

It is general that the gas pouring and charging step in the method of manufacturing the gas-charged electric switches is performed by utilizing a pressure reducing chamber. Here, the pressure reducing chamber is the one which renders a gas substitution to be performable by discharging the interior gas by means of a reduction of pressure and thereafter supplying an inert gas (or clean air), that is, conventionally, gas pouring and charging step is generally performed by accommodating the container which houses therein the electric switch and is sealed except gas substituting ports in the pressure reducing chamber and carrying out indirectly the gas substitution by means of the pressure reduction of the pressure reducing chamber and of the inert gas supply thereto. Next, in the conventional method, the container subjected to the gas substitution is temporarily sealed at the gas substituting ports, taken out of the pressure reducing chamber into the general atmosphere and tightly sealed at the gas substituting ports by such measure as heat adhesion or the like.

Therefore, according to such general method, the container has to be once carried into the pressure reducing chamber and to be again returned to the general atmosphere after performing the gas substitution so that certain difficulty is involved in incorporating the method in a part of an integrated continuous production line performed in the general atmosphere by means of a belt conveyer system, and further the method is rendered complicated since the sealing of gas substituting ports is made once temporarily in the pressure reducing chamber and thereafter finally in the general atmosphere. Since the gas substitution with respect to the container according to such general method is, further, indirectly performed as a result of the gas substitution made with respect to the entire pressure reducing chamber, it takes a considerable time for elevating the concentration of gas in the respective containers to a predetermined level and, further, since the gas fed into the pressure reducing chamber but not poured into the respective containers is originally unnecessary, there arise a remarkable want of economy specifically when an expensive gas is used.

DISCLOSURE OF THE INVENTION

A primary object of the present invention is, therefore, to provide a method of manufacturing gas-charged electric switches wherein the step of pouring and charging a gas into a container can be carried out in the general atmosphere so as to be economical.

Another object of the present invention is to provide a method of manufacturing gas-charged electric switches wherein the gas pouring and charging are quick and any loss of the gas is low.

Another object of the present invention is to provide a container optimum for working such manufacturing method as above.

According to the present invention, a gas substitution is performed in the general atmosphere and directly with respect to individual container containing an electric switch as tightly sealed except at gas substituting ports, whereby the above described objects are well achieved. Further according to the present invention, a gas is poured and charged into a container having a discharging path so as to gradually elevate the concentration of the gas in the container and to substantially discharge the gas out of the container, whereby the gas substitution is performed in a simple manner and features of the present invention achievable due to the gas substitution performed in the general atmosphere are further enhanced.

The method of manufacturing gas-charged electric switches according to the present invention shall be further explained in the followings with reference to accompanying drawings of embodiments.

FIG. 1 is a sectioned side view of an embodiment of a container suitable for working manufacturing method of the present invention;

FIGS. 2(*a*), (*b*) and (*c*) are explanatory views of the manufacturing method of this invention;

Figure 1:
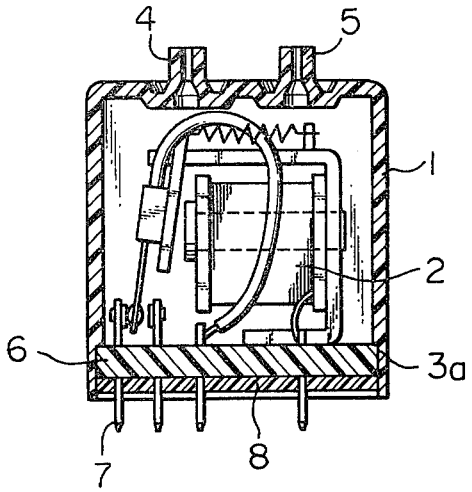
Figure 6A:
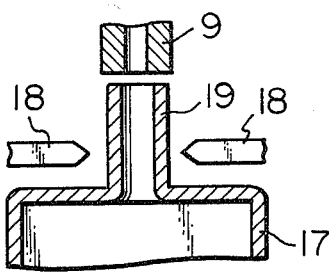
Figure 6B:
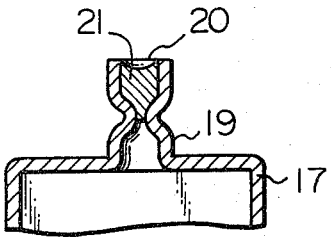
Figure 7A:
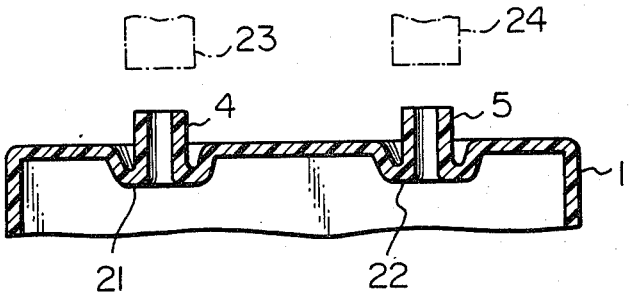
Figure 7B:
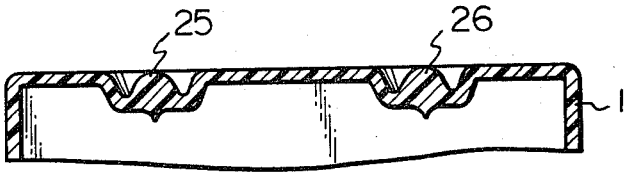

FIGS. 6(*a*) and (*b*) are fragmentary sectioned views for explaining an embodiment of the manufacturing method of this invention; and FIGS. 7(*a*) and (*b*) are sectioned side views of essential parts of the container in the embodiment of FIG. 1 for showing a state before the gas substitution and that after the tight sealing of the container.

In FIG. 1 showing an embodiment of a container specifically suitable for working the manufacturing method of the present invention, the container 1 is molded of such thermoplastic resin as a polyacrylate resin, polycarbonate resin, polyamide resin, polybutylene resin, terephthalate resin or the like so as to form in one direction of a box-like shape an opening 3 through which such an electric switch 2 as an electromagnetic relay or the like is put in and in the other different direction gas substituting ports 4 and 5 communicating the interior and exterior of the container with each other through a fine hole of an inner diameter of about 0.8 mm. The electric switch 2 is installed on an insulating base 6 consisting of a phenol resin, glass fiber reinforced nylon or the like and this insulating base 6 is brought into abutment with a step 3*a* in the opening 3 of the container 1 so as to close the opening 3. Electric connection of the switch to the exterior is made through terminals 7 projecting out of the container from the insulating base 6. A tight sealing of the opening 3 is achieved with a filler layer 8 consisting of an epoxy resin applied in a half-hardened state to the lower surface of the insulating base 6 and heated.

Figures 2A, 2B, 2C:
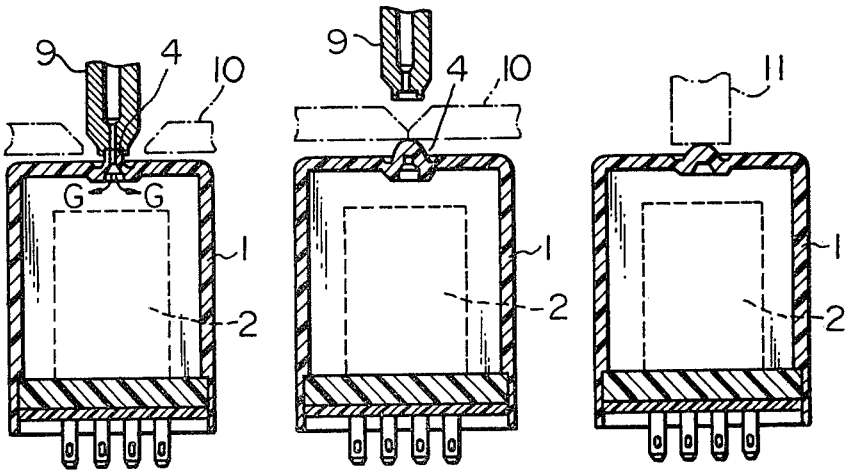

FIGS. 2(*a*), (*b*) and (*c*) are showing, in order to explain the manufacturing method of the present invention, positional relations in respective steps between the container 1, a nozzle 9 for feeding a gas into this container 1 and heating punches 10 for tightly sealing the gas substituting ports 4 and 5 of the container 1, as well as deforming states of the gas substituting ports 4 and 5.

Here, the nozzle 9 is of an inner diameter of about 1.2 mm. and is connected to a pressure tank not shown which storing such inert gas as nitrogen gas, argon gas or the like, such corrosive gas as sulfur, chlorine, or the like, such organic gas as Nox (nitrogen oxide) or clean air containing no moisture. The heating punches 10 are heated by an electric or other means in advance to a temperature of about 240° to 260° C., at which the thermoplastic resin material forming the container 1 melts.

According to the manufacturing method of the present invention, as shown in FIG. 2(*a*), first, the nozzle 9 is brought into close proximity to or butted against one, for example, 4 of the gas substituting ports, and a gas G is poured and charged into the container 1 by opening a valve of the pressure tank, so that the air staying in the container 1 will be discharged out substantially through the other gas substituting port 5 (see FIG. 3) due to that the concentration of gas G inside the container 1 is elevated as the gas pouring is continued and thereby the gas substitution will be performed. In this manner of gas substitution, a gas charging of a concentration of about 95% is performed by pouring the gas of a volume about twice as large as the volume of the container. When the concentration of the gas in the container 1 thus reaches a predetermined level, next, the container 1 is tightly sealed by closing the gas substituting ports 4 and 5. That is, as shown in FIG. 2(*b*), the tight sealing is performed in such that the nozzle 9 is separated upward from the gas substituting port 4 and the heating punches 10 are moved in the horizontal direction to hold, squeeze and melt the gas substituting port 4. If the height of tubular body of the gas substituting port 4 is made to be sufficient, the melting tight seal of the gas substituting ports 4 and 5 may be of course performed with the heating punches 10 while the nozzle 9 is brought into close proximity to or butted against the gas substituting port 4, that is, while feeding the gas into the container 1. FIG. 2(*c*) is to explain a step to be added as required for improving the appearance of tightly sealed portions of the gas substituting ports after the above described step, in which drawing the shape of the gas substituting ports 4 and 5 is finished with a heating jig 11 provided separately from the above referred heating punches 10 and moved toward the gas substituting ports 4 and 5 from above.

Figure 3:
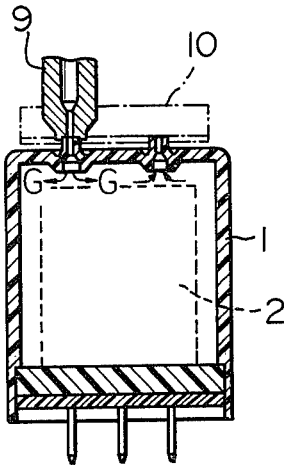
FIG. 3 is a sectioned side view of FIG. 2(*a*)
Figure 4:
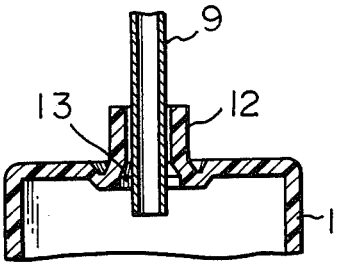
FIGS. 4 and 5 are fragmentary sectioned reference views for explaining respectively different gas substitution methods for explaining this invention.
Figure 5:
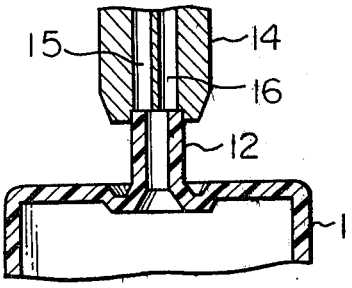

FIGS. 4 and 5 are reference views for explaining the features of the embodiment of FIG. 1 to 3 according to the present invention and, whereas the container 1 in the embodiment has two gas substituting ports, there are shown another aspects of the embodiment and having a single gas substituting port. In the case of FIG. 4, the nozzle 9 is inserted through a gas substituting port 12 of the container 1 so that its tip end will reach the interior of the container 1, the gas G fed from the pressure tank not shown is fed into the container 1 through the nozzle 9 and any gas to be discharged out of the container 1 is discharged through a clearance 13 between the inner wall of the gas substituting port 12 and the outer wall of the nozzle 9. While the manufacturing method of the present invention can be also worked in this aspect, there arise such difficulties that, if it is applied to a gas substituting port of a limited inner diameter, the inner diameter of the nozzle and the clearance 13 have to be made small and gas substituting speed is lowered, and that, if the inner diameter of the gas substituting port is made large enough for allowing the inner nozzle diameter and clearance 13 to be large on the contrary, the melting tight seal of the gas substituting port is hard to be perfectly achieved with respect to the container of a limited thickness. Therefore, it can be said that, though the present invention can be worked even by this embodiment, the before described embodiment is more advantageous in this respect.

Further, in the case of FIG. 5, a nozzle of a special structure is used, wherein this nozzle 14 is provided with two independent paths 15 and 16, one of which path 15 is connected to a pressure tank not shown so as to contribute to the gas feeding and the other of which path 16 is opened to the atmosphere so as to contribute to the exhaustion of gas inside the container. Even in such aspect of the invention, the respective feeding and exhausting paths are required for one gas substituting port, there is the same problem as in the aspect of FIG. 4.

FIGS. 6(*a*) and (*b*) are to explain an example of the gas substituting port sealing in the case where the material of the container 1 is a metal, wherein a gas substituting port 19 of a container 17 formed of a soft metal material is squeezed as in FIG. 6(*b*) by means of punches 18 movable in the horizontal direction (see FIG. 6(*a*)) and thereafter an opening 20 is filled with such molten metal 21 as a solder and tightly sealed.

FIGS. 7(*a*) and (*b*) show the tight sealed state of the gas substituting ports in the case according to the embodiment of FIG. 1, in which embodiment the gas substituting ports 4 and 5 are retracted at their opening bases 21 and 22 to be inside the container and below the top end surface of the container 1. While in the case of such structure the melting tight seal is achieved as shown in FIG. 7(*b*) by means of heating jigs 23 and 24 moved toward the respective gas substituting ports from above as shown in FIG. 7(*a*), the opening bases 21 and 22 of the gas substituting ports 4 and 5 in this case are retracted inside the container so that melted and sealed portions 25 and 26 will be positioned below the top end surface of the container 1, whereby the top end surface of the container 1 can be kept flat.

As has been explained with reference to the respective foregoing embodiments, according to the present invention, the container provided at least with two gas substituting ports is made hermetic except at the gas substituting ports by tightly sealing the opening for housing the electric switch after the switch is housed therein, then a gas is poured and charged into this container through the nozzle brought into close proximity to, butted against or inserted into one of the gas substituting ports while allowing any gas in the container to escape through the other gas substituting port and, when the concentration of the charged gas in the container has reached the predetermined level, the gas substituting ports are tightly sealed by the heating punches or the like with the container kept at its position or moved as required, whereby the gas charging is completed, so that the gas charging step can be made in the general atmosphere, thus, as compared with the conventional gas charging made within the pressure reducing chamber, improvements in respect of the loss of gas charged and gas substituting speed as well as the simplicity of the tight sealing of gas substituting ports are achieved, the exhaustion of air in the container by means of the pressure reducing chamber is not required by the gas supply only is sufficient since another gas exhausting path than the gas feeding path is provided in pouring and charging the gas, a positive melting tight seal is made possible since the inner diameter of each port can be made as small as possible and a minimization of the gas charging steps and the reliability thereof, as well as a simplification of working means can be further promoted.

BEST MODE FOR WORKING THE INVENTION

A container made of a thermoplastic resin and provided with two gas substituting ports is made hermetical except at the gas substituting ports by tightly sealing an opening after housing therein an electric switch, then a gas is poured and charged into this container through a nozzle butted against one of the gas substituting ports while a gas discharge is performed through the other gas substituting port and, when the concentration of the charged gas in the container has reached a required level, the gas substituting ports of the container are melted and tightly sealed with heating punches.

We claim:

1. A method of manufacturing gas-charged electric switches characterized in that an electric switch housing step in which an electric switch is housed in a container provided with two gas substituting ports and with an electric switch housing opening and said opening is tightly sealed, a gas pouring step in which a gas is poured through one of said gas substituting ports and a gas in the container is discharged through the other gas substituting port, and a gas sealing step in which the gas substituting ports are tightly sealed with punches are performed sequentially in the general atmosphere.

* * * * *